US005894609A

United States Patent [19]

Barnett

[11] Patent Number: 5,894,609

[45] Date of Patent: Apr. 20, 1999

[54] SAFETY SYSTEM FOR MULTIPLE DRAIN POOLS

[76] Inventor: Ralph L. Barnett, 2721 Alison La., Wilmette, Ill. 60091-2101

[21] Appl. No.: 08/811,203

[22] Filed: Mar. 5, 1997

[51] Int. Cl.[6] ..... E04H 4/12

[52] U.S. Cl. ..... 4/504; 4/509; 417/503

[58] Field of Search ..... 4/490, 507, 509, 4/504; 417/493, 503

[56] References Cited

U.S. PATENT DOCUMENTS 2,071,800 2/1937 Mock ..... 417/493 X
2,266,126 12/1941 Malsbary et al. ..... 417/503 X
2,979,733 4/1961 Saint Clair et al. ..... 4/490 X
4,240,165 12/1980 Kyrias ..... 4/509 X
4,530,120 7/1985 Etani ..... 4/490 X

*Primary Examiner*—Robert M. Fetsuga
*Attorney, Agent, or Firm*—Hamman & Benn; Jack Shore

[57] ABSTRACT

A method and apparatus for alternately providing and releasing suction to a plurality of pool drains or if desired alternately providing suction and liquid under pressure to pool drains to prevent one from becoming stuck to the drains. This includes introducing a valve arrangement between the drains and the suction pump which is continuously operated to control the flow between the drains and the pump.

11 Claims, 3 Drawing Sheets

SAFETY SYSTEM FOR MULTIPLE DRAIN POOLS

FIELD OF THE INVENTION

This invention relates to hot tubs, pools, whirlpools, or the like, that are used in private homes or athletic clubs that involve the use of a plurality of drains through which water is sucked out and drained or recirculated through jets, or the like, located around the interior perimeter of the tub or pool. These tubs or pools are of a depth to where people may advertently or inadvertently sit on and completely block a drain.

BACKGROUND OF THE INVENTION

In the typical whirlpool or hot tub, the water is normally pulled out of the hot tub or whirlpool through a drain system at the base of the tub into the inlet of a suction pump and then drained or recirculated back to the tub or pool through jets located around the interior wall of the pool or tub. The jet action or pulsing effect provides a relaxing environment to the individuals sitting in the relatively hot water. It is well known that whirlpools containing turbulent hot circulating water has a therapeutic effect on the occupants.

In conventional hot tubs and whirlpools currently in use, drains are subject to constant suction by the pumps to provide the recirculating effect and the turbulence in the pool to bring about the desired therapeutic effect. Since it is possible that an individual sitting in the pool may be in the immediate proximity of a drain, there are concerns that one may not be readily able to remove oneself therefrom. There are two reasons for this. One is the possibility that the forces holding the individual on the drain due to the pump suction are often of a sufficient strength to prevent one from lifting themselves from the drain and exiting from the pool or tub. Even the smallest pump is capable of developing very high suction levels. The second possibility is the whirlpool or undertow effect that produces fluid flow patterns that capture and retain a bather. This concern is particularly great when large horsepower pumps are used that create high flow rates in the neighborhood of the pool drains. Unfortunately, there is often no ready way to turn off the pump to eliminate the suction or high flow effect which could hold one on or in the neighborhood of the drain and cause injury or possibly result in someone drowning. The industry has suggested methods for eliminating the development of high suction levels through the use of multiple interconnected drains. These low-tech solutions recognize that disembowelment occurs very rapidly when bathers sit on non-interconnected drains and effectively stop all flow. The industry has also proposed pressure detection devices that shut off the pump at preset critical suction levels. These high-tech solutions raise questions of reliability, calibration, stability, and maintenance capability by foreseeable pool operators. To deal with the whirlpool or undertow problem, the industry has suggested limitations on the drain flow rate. Unfortunately, high capacity large horsepower systems for the larger pools cannot usually adopt low flow rates at the drains without compromising, for example, the aggressive nature of recirculating jets used for therapeutic treatment in hot tubs. This high drain flow rate problem which gives rise to the whirlpool or undertow effect has not been addressed by the industry.

SUMMARY OF THE INVENTION

In accordance with the present invention, there is provided a system for periodically removing the suction source from each drain in the pool or tub so that one sitting on a drain can readily remove himself from the drain for all practical purposes whenever desired. For example, the system can be designed so that every few seconds the suction will be released, during which time anyone sitting on the drain can easily and conveniently remove themselves from the drain if in fact there is suction or flow tending to hold them on or near the drain in the first instance. In addition, if desired, the system can be designed to alternate the suction with an introduction of water under a positive pressure up through the drain to assist one in their removal effort.

This is accomplished in pools where the designs of the tubs include more than one drain by providing a pumping system in conjunction with a valve arrangement whereby the suction imposed on any given drain is intermittent. This prevents one from potentially being stuck to the drain for any prolonged length of time, since the release of the suction eliminates the sucking pressure or flow acting on one sitting on or near the drain, thus allowing the person to easily remove themselves from the drain surface even if one is covering the entire drain. The pool or tub will continue to function in its normal manner since during the intermittent operation at least one of the drains is subject to the suction permitting the pump to withdraw water from the pool and return it via the jets located alongside the interior perimeter of the pool.

In an illustrated embodiment, there is shown an alternately operating valve assembly located between a pair of drains and the inlet of a suction pump. The drains are alternately subject within a very short time to (1) the input suction action of the pump to draw water from one drain and then (2) receive water under pressure from the outlet of the pump through an orifice and check valve back through the drain while the balance of the water being pumped flows to jets directing water under pressure into the pool or to discharge.

While we have herein referred to a pool having two drains, the invention is applicable to any number of drains as, for example, having pairs of drains leading to a single duct. With a larger number of drains, they could be combined as desired so they are alternately subjected to suction and pressure to prevent one from being stuck or held in the vicinity of any given drain for any significant period.

The valve is a simple valve construction including a valve control member that is moved to alternately interconnect the inlet of the pump first to one drain and then to the other drain and then back again, which valve is controlled in various ways as set forth in the attached drawings.

In one embodiment, there is employed a three-way ball valve that uses a rocker crank mechanism to alternate the connection between the pump inlet and separate drains. The pump outlet is shown feeding water under pressure back to the tub, but no water under pressure is recirculated back up through the drains.

In another embodiment, the valve mechanism to control the flow between the drains and the pump includes a simple lever assembly connected to a valve actuator at one end which lever assembly is connected to a crank driven at a fixed speed which as it rotates moves the valve between positions to change the connections between the respective drains and the inlet of the pump.

A third embodiment employs a pair of solenoids connected to a valve actuator having an adjustable timer that alternately energizes a pair of solenoids in accordance with the timing set to move the valve member between two positions to alternately provide for suction or positive pressure to the water in any given drain.

A fourth embodiment shows pairs of drains connected to a single conduit.

While as aforementioned the invention can be employed with a plurality of drains, the embodiments illustrated are shown in connection with a tub having two or four drains wherein for the most part only one or two drains are connected at any given time to the inlet of the pump as the valve is alternated between positions.

BRIEF DESCRIPTION OF THE DRAWINGS

Referring now specifically to the drawings, it is seen that

DESCRIPTION OF THE PREFERRED EMBODIMENTS

Figure 1:
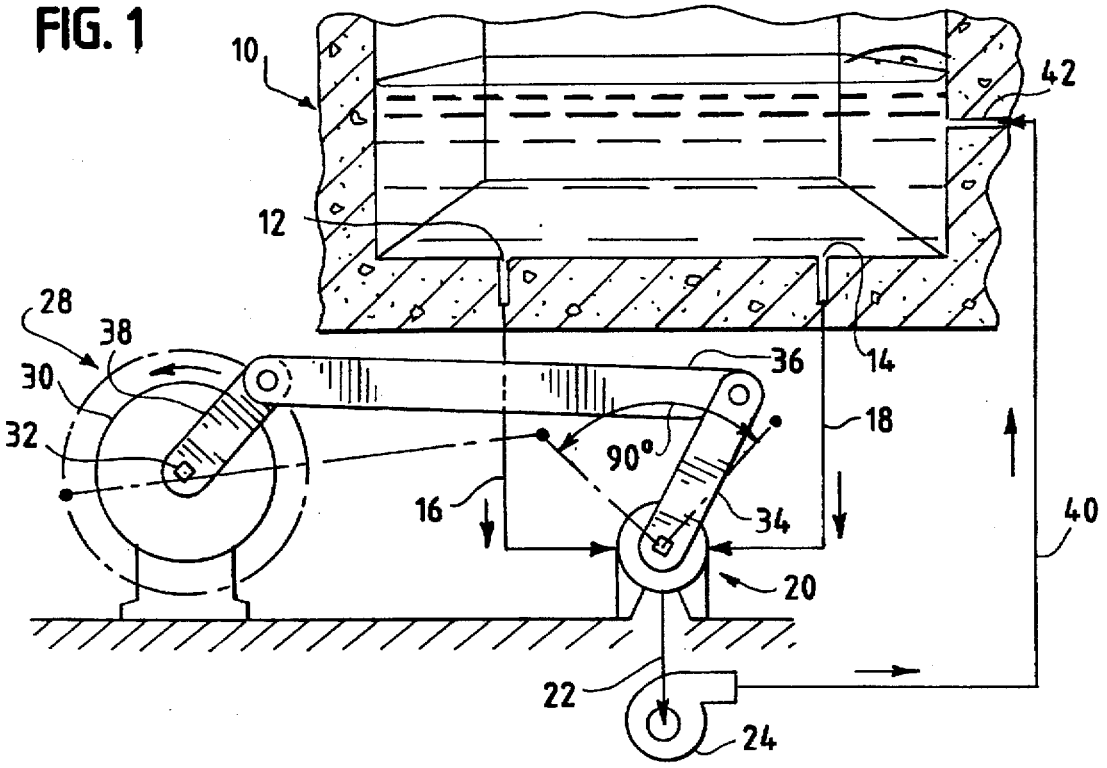
FIG. 1 shows a safety system for pool drains employing a three-way ball valve operated by a motor linkage arrangement for alternately regulating the flow of fluid from the drains to the inlet of a fixed displacement unidirectional pump.
Figure 2:
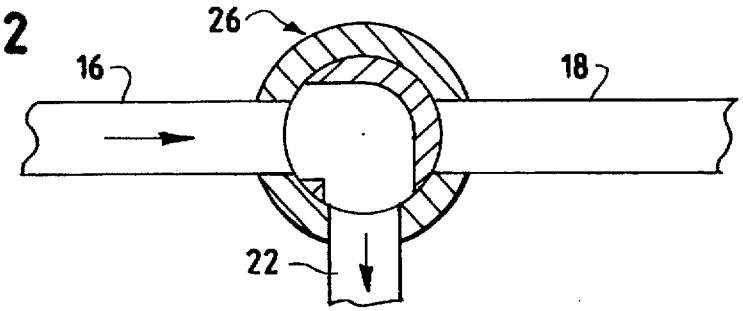
FIGS. 2, 3, and 4 are cross-sectional views illustrating the various positions of the valve during its controlling of the flow between the drains and the pump inlet.
Figure 3:
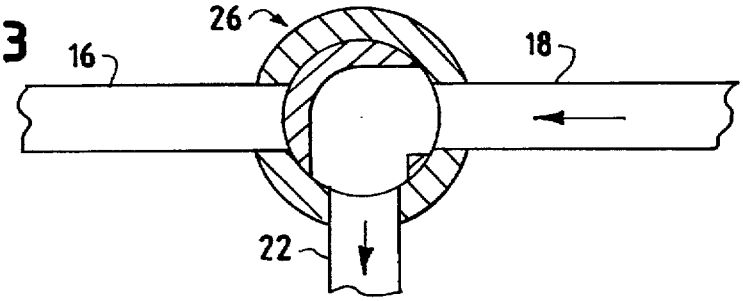
Figure 4:
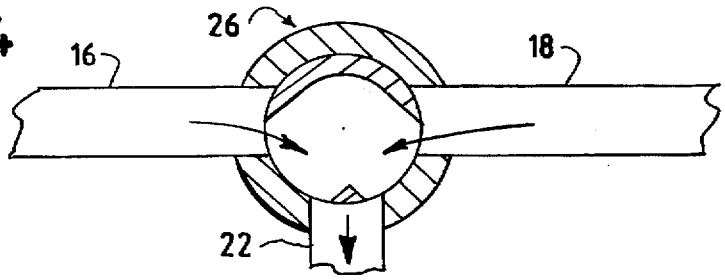

In FIG. 1, there is schematically illustrated the base of a hot tub or whirlpool 10 containing drains 12 and 14 leading to conduits 16 and 18, respectively. The conduits 16 and 18 lead to a valve assembly 20 which functions to control the flow between the conduits 16, 18 and the conduit 22 leading to the inlet of the pump 24. The valve assembly includes a three-way ball valve 26, the movement of which is controlled through a crank mechanism 28 that connects the valve 26 to a motor 30 containing a shaft 32 that is continuously driven. The linkage mechanism consists of a first link 34 that is connected at one end to the ball valve 26 and at its other end to link 36. Link 36 is connected at its other end to link 38 which is connected to and driven by rotating shaft 32. The rotation of shaft 32 results in moving the linkage through the 90° angle shown in FIG. 1 during which the ball valve is moved through the positions shown in FIGS. 2–4. Essentially, the shaft 32 moves through a 360° action which moves the ball valve 26 between the positions shown in FIGS. 2, 3, and 4. FIGS. 2 and 3 are the extreme positions in which conduit 16 connects with outlet conduit 22 in the first extreme position and in the other extreme position conduit 18 connects with conduit 22. FIG. 4 shows an intermediate position wherein during the movement of the ball valve between its extreme positions both conduits 16 and 18 are in communication with conduit 22. The outlet of the pump 24 flows to conduit 40 that leads back into the pool through jets 42.

Figure 5:
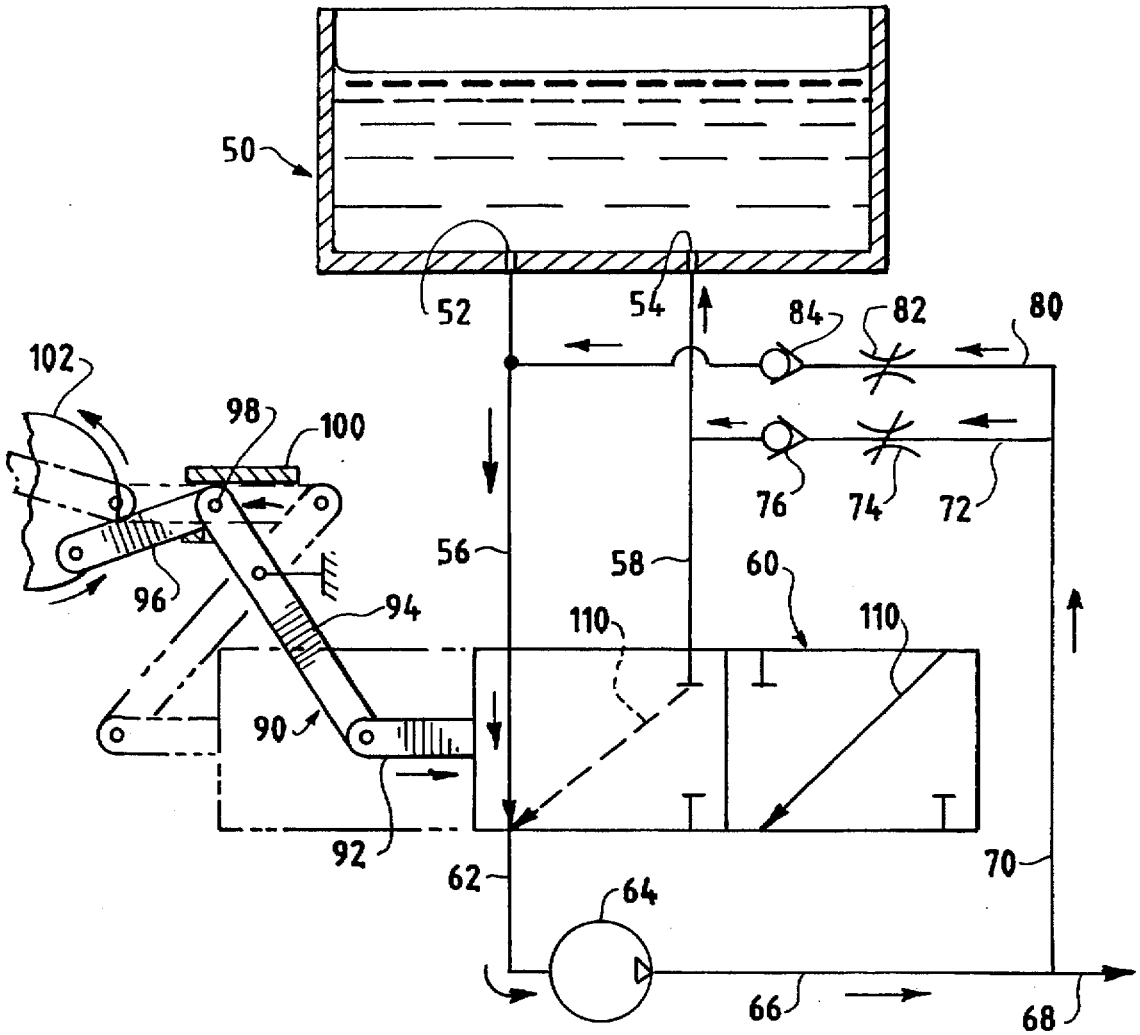
FIG. 5 is a system similar to FIG. 1 embodying a power driven rotating crank mechanism connected by a lever arrangement to a valve actuator of a three-way, two-position valve controlling the flow from the drains to the inlet of a pump in which a portion of the outlet of the pump is directed back to the pool through the drains.

Referring now to FIG. 5, there is illustrated another embodiment of the invention. In this arrangement, a pool 50 containing drains 52, 54 empties into conduits 56, 58, respectively. The conduits 56 and 58 lead to a three-way, two-position valve 60 which in the illustrated position the valve has been positioned so that the flow of water from conduit 56 flows through valve 60 to conduit 62 leading to the inlet of the pump 64. The outlet of the pump leads to conduit 66 and the major portion of the water therein flows to discharge or to jets (not shown) in the tub through conduit 68. In addition, a relatively small portion of the water under pressure in line 66 flows through conduit 70, conduit 72, flow control valve 74, and check valve 76 into conduit 58, leading back into the pool 50 through drain 54. Flow control valve 74 may be (a) of the adjustable non-compensated type or (b) of the pressure compensated adjustable type as desired.

The operation of this embodiment is as follows:

Activation of the suction pump 64 draws liquid out of the pool through drain 52, conduit 56, valve 60, conduit 62 into the inlet of the suction pump 64. The outlet of the pump is for the most part directed through conduits 66 and 68 to a drain or back to the pool and a smaller portion of the liquid is directed back through conduits 70, 72, flow control valve 74, and check valve 76 to introduce water under pressure through the drain 54 to assist in repelling any material tending to clog the drain or anyone sitting thereon. Essentially, it provides a positive pressure which is clearly indicated to one sitting on the drain and is aware that they can readily remove themselves from the drain if they so choose. It is to be noted that the flow through conduit 70 also enters conduit 80 and flows through control valve 82 and check valve 84 into conduit 56 and back to the inlet of the pump. As referred to later, this is provided to introduce liquid under pressure to drain 52 when valve 60 is moved to its alternate position as hereinafter discussed.

In accordance with the invention, the suction imposed on each drain is to be periodically released, and to this end, the valve 60 must be repositioned to alternately release the suction pressure from drain 52 and apply suction to drain 54 and then back again to drain 52. To accomplish this, the position of the valve 60 is continuously repositioned by a lever mechanism 90, which lever mechanism is connected to the valve actuator rod 92. The lever mechanism consists of a pair of pivotally connected rods 94, 96 that are connected together by pin 98 within frame structure 100. The end of the rod 96 is connected to a motor-driven member 102 which during its 360° rotation moves the lever 96 to move the lever 94 and actuator 92 in a reciprocating motion between two positions.

When the actuator 92 is moved to the position shown in dotted lines, conduits 56 and 62 are disconnected to prevent a suction pressure from being imposed on the water leading from drain 52. At this time, the valve has moved to connect conduits 58 and 62 through conduit 110 as shown by the movement of the internal valve connection 110 to the dotted position to impose a suction pressure on drain 54. When this action occurs thus releasing the suction in conduit 56, the water under positive pressure in conduit 70 will flow through conduit 80, flow control valve 82, and check valve 84 into conduit 56 and up through drain 52.

It is to be noted that a full suction will not be drawn by the pump 64 due to the recirculation of water flowing through conduit 70 and conduits 72 or 80 depending on which one is connected to the pump inlet during a given cycle.

Figure 6:
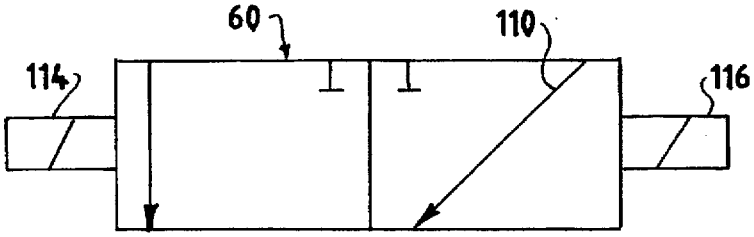
FIG. 6 is an embodiment of a valve control mechanism in which the valve is controlled by a solenoid arrangement that is part of an electrical circuit including an adjustable timer to control the positioning of the valve actuator.

Referring now to FIG. 6, there is schematically illustrated a valve assembly similar to that shown in FIG. 5, but in place of the lever actuator driven by a crank at a fixed speed, there are illustrated solenoids 114, 116 that are part of a conventional circuit including a timing device (not shown) that alternately activates each solenoid. The timer controls the action of the solenoids to alternately move the valve member in valve 60 between positions alternately connecting conduits 56 and 58 with pump inlet conduit 62 as described in detail with respect to the embodiment of FIG. 5.

Every few seconds, any differential pressure acting to hold anyone in position against the drain will be released and therefore anyone even temporarily pulled against the drain will be free of the drain and capable of removing themselves from the drain at any time without difficulty.

Figure 7:
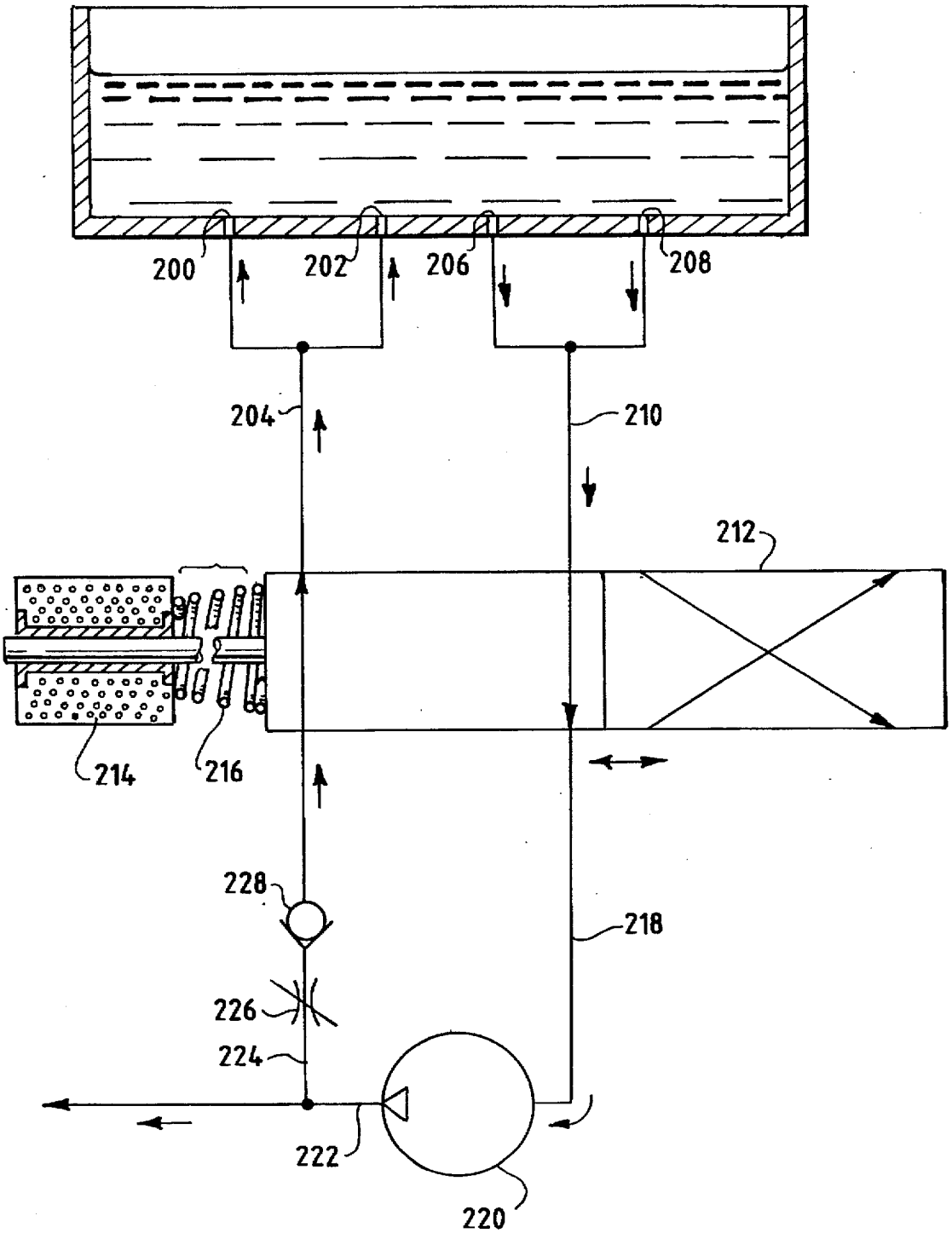
FIG. 7 is an embodiment in which a pair of drains each leads into a single conduit.

FIG. 7 is a further embodiment illustrating the system employed in which a pair of drains each leads into a single conduit. Specifically, drains 200, 202 lead into conduit 204 and drains 206, 208 feed into conduit 210. Valve 212 is shown operated by a solenoid 214 against the action of spring 216 that when periodically actuated alternately connects conduits 210 and 204 to conduit 218 leading to the inlet of pump 220. As illustrated, a major portion of the flow from pump 220 is recirculated back to the pool through conduit 222. In addition, a relatively small portion of the water under pressure in line 222 flows through conduit 224, flow control valve 226, and check valve 228 into conduit 204 leading back into the pool through drains 200, 202.

Periodically, as desired, the solenoid will be activated to reposition valve 212 to interconnect conduit 204 to conduit 218 and conduit 224 to conduit 210 to suck the water from drains 200, 202 while introducing water under pressure to drains 206, 208 as discussed with respect to the other embodiment.

In this embodiment, it will be appreciated that a full suction will not be drawn by the pump 220 if only one of the pairs of drains is fully covered.

It is, of course, intended to cover by the appended claims all modifications that come within the true spirit and scope of the invention.

What is claimed is:

1. A swimming pool having a water circulating system (for withdrawing water from) including at least first and second drains (of a pool), said water circulating system withdrawing water from the pool through the drains without causing injury to anyone possibly sitting on or near said pool drains and also including a suction pump having an inlet and an outlet, a first and second conduit means (adapted to connect) connecting the first and second drains to the pump inlet, valve means interposed between said first and second conduit means and pump inlet, means for continuously actuating at substantially equal intervals said valve means to alternately connect the first and second conduit means to the pump inlet whereby when suction is imposed on the first conduit means it will be released from the second conduit means and vice versa whereby anyone sitting on or near a drain will be alternately relieved of the suction pressure or flow induced forces imposed by the pump.

2. A system as set forth in claim 1 including conduit means adapted to connect the outlet of the pump to outlets in the interior periphery of the pool to recirculate a portion of water withdrawn from the drains back to the pool.

3. A system as set forth in claim 2 including conduit means adapted to connect the outlet of the pump with said drains whereby a portion of the water from the pump outlet is directed back through said drains not subjected to a suction pressure to provide a positive pressure up through said drains to assist in unclogging them.

4. A system as set forth in claim 1 in which the valve means consists of a rotating ball valve means and the actuating means consists of a continuously operating motor that drives a linkage mechanism connected to the ball valve to position the valve to move from where it connects the first conduit means to the pump inlet, both conduit means to the pump inlet and then the second conduit means to the pump inlet and then reverses itself.

5. A system as set forth in claim 1 in which the valve means is linear and the actuating means includes a crank-operated linkage that is continuously rotated to move the valve means to alternately connect the first conduit means to the pump inlet and then the second conduit means to the pump inlet.

6. A system as set forth in claim 1 in which the valve actuating means consists of a pair of solenoids that move the valve means between its alternate positions which solenoids are controlled by a timing mechanism.

7. A method for withdrawing water from a drain in a pool without capturing anyone bathing near a drain in a flow pattern consisting of the steps of sucking water by a pump from the drain and valving the flow between said pump and said drain and continuously alternately connecting said drain to said pump at substantially equal intervals whereby a drain will be connected to the pump to have water drawn therethrough and then released from the pump suction to permit any one sitting near the drain to be released from the pattern and remove themselves if desired.

8. The method as set forth in claim 7 including the step of recirculating at least some of the water withdrawn from the pool by the suction pump to outlets located around the inside perimeter of the pool by connecting up the outlet of the pump with said outlets.

9. The method as set forth in claim 8 including the step of recirculating at least some of the water withdrawn from the pool by the suction pump to the pool back through said drain when the suction is not acting thereon by connecting the outlet of said pump with said drain which water will provide a positive upward pressure on anything or anyone acting to block the drain.

10. The method set forth in claim 9 including interconnecting the drain with another drain to prevent the development of almost full suction pressures on anyone completely blocking the drain.

11. The method as set forth in claim 1 including the step of using a timer to set the time of the valving to alternately connect the drains to the suction pump to insure that the suction effected is essentially transitory.

* * * * *